US005545453A

United States Patent [19]

Grant

[11] Patent Number: 5,545,453

[45] **Date of Patent: *Aug. 13, 1996**

[54] CONFORMABLE INSULATION ASSEMBLY

[75] Inventor: Larry J. Grant, Westerville, Ohio

[73] Assignee: Owens Corning Fiberglas Technology, Inc., Summit, Ill.

[ * ] Notice: The term of this patent shall not extend beyond the expiration date of Pat. No. 5,508,079.

[21] Appl. No.: 309,237

[22] Filed: Sep. 20, 1994

Related U.S. Application Data

[63] Continuation-in-part of Ser. No. 290,053, Aug. 15, 1994.

[51] Int. Cl.[6] ..... B32B 3/02; B32B 3/10; E04B 1/78; E04C 2/30

[52] U.S. Cl. ..... 428/43; 74/77; 52/406.1; 52/406.2

[58] Field of Search ..... 428/74, 43, 77; 52/406.1, 406.2

[56] References Cited

U.S. PATENT DOCUMENTS

| | | | |
|---|---|---|---|
| 1,947,788 | 2/1934 | McIntyre | 154/44 |
| 2,172,048 | 9/1939 | Johnson | 20/4 |
| 3,003,902 | 10/1961 | McDuff | 154/44 |
| 3,338,777 | 8/1967 | Irwin et al. | 161/154 |
| 3,958,385 | 5/1976 | Bondra, Jr. et al. | 52/404 |
| 4,646,499 | 3/1987 | Wilson | 52/408 |
| 4,952,441 | 8/1990 | Bose et al. | 428/121 |
| 5,099,629 | 3/1992 | Gay | 52/406 |
| 5,236,754 | 8/1993 | McBride et al. | 428/74 |

FOREIGN PATENT DOCUMENTS

| | | |
|---|---|---|
| 0303537 | 2/1989 | European Pat. Off. . |
| 1327144 | 4/1962 | France . |
| 7506411 | 9/1976 | France . |
| 5591656 | 7/1980 | Japan . |

*Primary Examiner*—Alexander S. Thomas
*Attorney, Agent, or Firm*—C. M. Gegenheimer; C. B. Brueske

[57] ABSTRACT

A multiple conformable insulation assembly is provided and includes at least two mineral fiber batts of a binderless fibrous material of substantially long fibers interconnected to one another. Interconnection allows for the simultaneous installation of multiple batts. The insulation assembly is capable of conforming and expanding its shape to an area into which it is installed better than prior art insulation assemblies. The batts are preferably interconnected through the use of a support layer.

19 Claims, 4 Drawing Sheets

CONFORMABLE INSULATION ASSEMBLY

BACKGROUND OF THE INVENTION

This application is a continuation-in-part of earlier U.S. patent application Ser. No. 08/290,053, pending for CONFORMABLE INSULATION ASSEMBLY by Larry J. Grant. et al, filed Aug. 15, 1994.

This invention relates to a conformable insulation assembly which is used to insulate buildings and, for example to insulate floors, ceilings, walls and the like of such buildings.

It is well known in the art to insulate buildings using various types of insulating materials including mineral fibers such as fibrous glass wool.

The common prior art methods for producing glass fiber insulation products involve producing glass fibers from a rotary fiberizing process. A single molten glass composition is forced through the orifices in the outer wall of a centrifuge or spinner, producing primarily straight, short glass fibers. The fibers are drawn downward by a blower. The binder required to bond the fibers into a wool product is sprayed onto the fibers as they are drawn downward. The fibers fall downward onto a conveyor. The fibers are collected in generally horizontal layers on the conveyor as they fall forming a wool pack. The wool pack is further processed into insulation products by heating in an oven, and mechanically shaping and cutting the wool pack, for example, into a rectangle.

Prior art glass wool blankets are generally rectangular, horizontally layered and substantially rigid in nature. As previously stated, they often include a binder, such as a phenolic resin, added to the glass wool subsequent to the fiberizing process. The resultant insulating material has sufficient strength and rigidity to be employed as insulating blankets in walls, floors and ceilings.

However, prior art glass wool blankets, due to their rectangular shape, use of primarily short fibers and rigid nature have no ability to conform to the spaces of a building into which they are installed. That is, building construction inevitably contains abnormal voids, for example, spaces created between floor, wall, and ceiling joists, as a part of the framing construction or non-uniformly shaped barriers such as electrical wiring, boxes and plumbing. Existing insulation blankets, being generally rectangular, composed of primarily short fibers and substantially rigid, are unable to conform to and fill these abnormal voids. As a result, the effectiveness of the insulation is diminished as local convection air currents can be created in the abnormal voids. Alternatively, the installer must cut the insulation to fit into the voids, increasing the time required to do the project. Further, some existing insulation blankets for attics are designed to fit between the spacings of support timbers or joists. Thus, a gap corresponding to the width of the support timber or joist is left between neighboring insulation blankets. These gaps also reduce the blankets effectiveness, as well as provide an unsatisfactory appearance.

In addition, in the production of wool insulating materials of glass fibers, it becomes necessary to use fibers that are relatively short to achieve desired lattice properties. Long fibers tend to become entangled with each other, forming ropes, strings or more wispy entanglements. The aerodynamic properties of long fibers make them difficult to distribute, and conventional lapping techniques are largely ineffective in handling long fibers. The ropes of long fibers produce a commercially undesirable appearance and reduce the insulating abilities of the glass wool.

A further problem presented by the use of short straight fibers is the binder material which must necessarily be added to the fibers to provide product integrity. Binder provides bonding at the fiber to fiber intersections in the insulation blanket lattice. However, binders are expensive and have several environmental drawbacks. As most binders include organic compounds, great pains must be taken to process effluent from the production process to ameliorate the negative environmental impact. Further, the binder must be cured with an oven, using additional energy and creating additional environmental cleanup costs. While long fibers display some fiber to fiber entanglement, even without binder, the non-uniformity of the resulting wool packs has long made them commercially undesirable.

Non-wool insulation products, such as loose fill, are also known. These loose fill products are conformable in the sense that they have no preordained shape. Loose fill is merely individual groups of insulation fibers. The insulation is generally installed by blowing into the area to be insulated. However, the insulation is difficult to handle, requires special equipment to install and due to its installation technique and loose nature, loose fill commonly has airborne particles, is irritable to the skin and leaves gaps and voids when blown into the cavity.

Recently, binderless wool insulation products have been developed. U.S. Pat. No. 5,277,955 to Schelhorn et al discloses a binderless insulation assembly. The insulation assembly comprises a mineral fiber batt, such as glass fibers, enclosed within an exterior plastic covering. Binder is not required. A layer of adhesive holds the plastic cover to the fiber batt. However, the insulation assembly of Schelhorn et al is not generally capable of conforming to the voids in construction spaces or filling the gaps between blankets because the fiber batt is made of primarily straight, short glass fibers, and the batt is formed into a rectangle by cutting the fibers prior to enclosing the batt in the plastic cover.

Accordingly, the need remains for a conformable wool insulation assembly which conforms to abnormal voids in building spaces, is relatively easy to install, and does not have the drawbacks of loose fill insulation.

SUMMARY OF THE INVENTION

This need is met by the present invention whereby a conformable insulation blanket as well as a conformable insulation assembly is provided. The insulation of the present invention is adapted to expand and conform its shape into areas into which it has been installed, such as abnormal voids in building spaces.

In accordance with the present invention, a conformable insulation blanket and assembly are provided. The conformable insulation blanket comprises at least one mineral fiber batt. The batt is manufactured from a binderless, fibrous material of substantially long fibers. The fibers are preferably oriented within the batt in a generally spiral relationship when viewed from an end of the batt, although horizontally layered fibers may also be used. The fibrous batt includes a top, bottom and two opposing spaced apart sides. The opposing sides preferably remain uncut during manufacture of the blanket. In this manner, the batt is adapted to expand and conform its shape to an area into which the batt is installed.

Preferably, the mineral fiber batt is a fibrous glass batt. Ideally, the fibers are irregularly-shaped glass fibers, although traditional straight fibers may also be employed. Further, the fibrous glass batt may be a fibrous glass wool having a density of less than 0.6 pounds per cubic foot (p.c.f.). The insulation blanket of the present invention may further comprise an exterior layer on at least one of the top and bottom surfaces of the fibrous glass batt. The exterior layer may be selected from the group consisting of plastic, metallized films, Kraft paper, non-woven materials and combinations thereof. Preferably, the exterior layer is plastic, ideally polyethylene, with a thickness of less than 1.0 and more preferably between 0.2 and 0.6 mil. If desired, more than one fibrous batt may be encapsulated within the same exterior layer. Means for restricting movement between the exterior layer and the fibrous glass batt may also be included.

In an additional embodiment of the present invention, there is provided an insulation assembly comprising at least one fibrous glass batt, an exterior plastic layer covering the glass batt and means for restricting movement between the exterior plastic layer and the glass batt. Again, the assembly is adapted to expand and conform its shape to an area into which it is installed.

The fibrous glass batt is manufactured from binderless, substantially long glass fibers. These fibers are preferably oriented within the glass batt in a generally spiral relationship when viewed from an end of the glass batt. Preferably, the glass fibers are irregularly-shaped glass fibers, although traditional straight fibers may also be employed. The glass batt is ideally a fibrous glass wool having a density of less than 0.6 p.c.f. Again, the batt has a top, bottom and two opposing spaced apart sides which remain uncut during manufacture of the assembly.

The exterior plastic layer comprises a thermoplastic polymer such as polyethylene. The plastic layer is preferably less than 1.0 mil thick, and more preferably, between 0.2 and 0.6 mil thick. The means for restricting relative movement between the exterior layer and the batt is usually an adhesive material, although other means, such as, for example, fasteners, may also be used. An air passage may also be provided. Again, if desired, more than one fibrous batt may be included within one exterior layer.

In a further embodiment of the present invention, a multiple conformable insulation assembly is provided. The assembly comprises at least two mineral fiber batts spaced apart by a defined distance. The mineral fiber batts are composed of binderless substantially long fibers and are adapted to expand and conform their shape to an area into which each batt has been installed. The mineral fiber batts are then interconnected to one another.

The batts are preferably interconnected by the use of a support layer. The support layer is selected from the group consisting of plastic, metallized film, Kraft paper, non-woven materials and combinations thereof. Preferably, the support layer is a plastic film. The support layer may further include perforations to allow separation of the mineral fiber batts from the system. The batts are preferably attached to the support layer through the use of an adhesive. Also, the defined distance which the batts are separated is preferably the width of standard construction members, such as joists or studs.

The individual mineral fiber batts are similar to the conformable insulation in earlier embodiments. That is, the long fibers are preferably oriented within each batt in a generally spiral relationship when viewed from an end of each batt. The mineral fibers may be irregularly-shaped glass fibers. Each batt may have a top, bottom and two opposing sides with the opposing sides remaining uncut during the manufacture of the assembly. Each fiber batt may further include an exterior layer on at least one surface being selected from plastic, metallized film, Kraft paper, non-woven materials and combinations thereof, but is preferable plastic and completely encapsulating each batt.

BRIEF DESCRIPTION OF THE DRAWINGS

FIG. 3A after manufacture, FIG. 3B after compression, FIG. 3C after recovery from compression and FIG. 3D after installation, respectively.

DETAILED DESCRIPTION OF THE PREFERRED EMBODIMENTS

The present invention comprises a conformable insulation blanket and a conformable insulation assembly. The conformable insulation is adapted for expanding and conforming to abnormal voids and spaces in areas into which the conformable insulation is installed. This ability to expand and conform is a significant advancement over the prior art.

Figure 1:
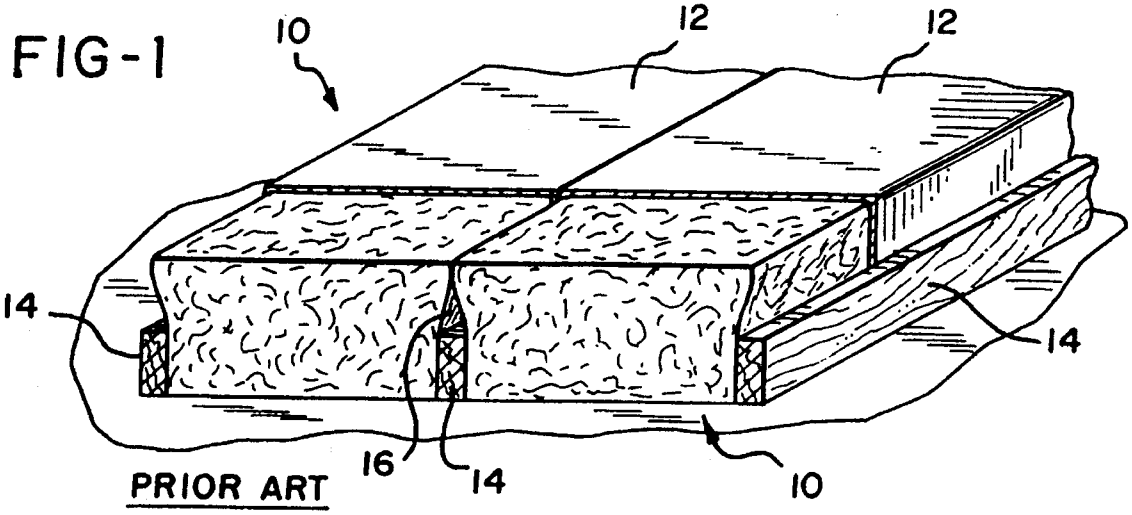
FIG-1 PRIOR ART
FIG. 1 is an end perspective view of the layered, cut, generally rectangular insulation of the prior art.

FIG. 1 depicts an insulation blanket of the prior art. In FIG. 1, although the dimensions are exaggerated for clarity, there is shown a pair of generally rectangular mineral fiber batts 10 having cut sides and ends with an exterior layer 12 on the batts. Batts 10 are disposed between standard construction joists 14. As can be seen, due to the generally rectangular shape and horizontal layering of batts 10, a void or space 16 is left between the installed batts. If batts 10 were, for example, 9.5 inches (24 cm) in thickness, void 16 would be about 4.0 inches (10.5 cm) in height and 1.5 inches wide (4.0 cm). These voids reduce overall insulation performance.

The conformable insulation of the present invention expands and "fills" the abnormal voids and spaces inherent in building construction, such as those resulting from non-uniformly spaced or shaped joists or support members. Further, the conformable insulation of the present invention is capable of being adapted to spaces in which various obstacles such as electrical wiring and junction boxes, HVAC ductwork, plumbing or other obstructions, have been placed. Prior art insulation can require extensive cutting to properly fit such spaces. The conformable insulation of the present invention, on the other hand, requires less cutting and the insulation will expand and conform around the obstacle better than prior art insulation reducing or eliminating voids and spaces.

Figure 2:
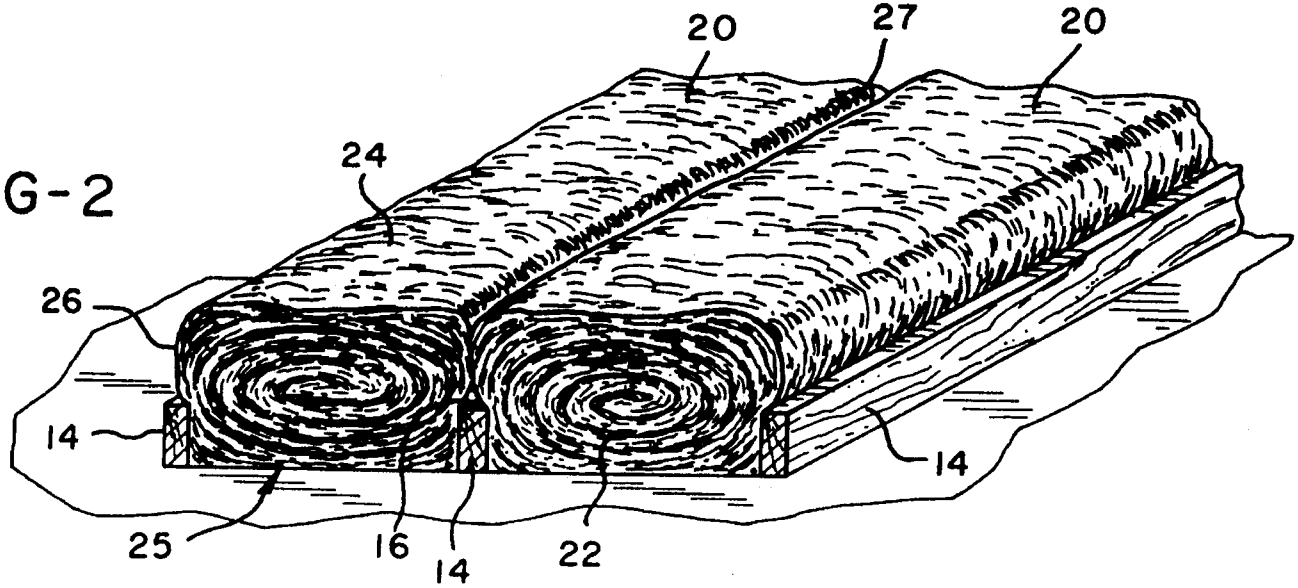
FIG. 2 is an end perspective view of the preferred conformable insulation of the present invention.

This filling of the voids enhances the overall thermal performance of the insulation system. FIG. 2 depicts the conformable insulation of the present invention. In FIG. 2, again exaggerated for clarity, there is shown a pair of conformable insulation mineral fiber batts 20 disposed between joists 14. As can be clearly seen, conformable insulation 20 has expanded and conformed to the area of installation. If fiber batt 20 is, for example, 9.5 inches (24 cm) in thickness, void 16 would be about 1.5 inches (4 cm) in height. As a result, void 16 is substantially reduced from the void of the prior art. In this manner, the local convection currents are reduced and in many cases eliminated.

While not wishing to be bound by a specific theory, it is believed that the advantageous results of the present invention are obtained from a combination of two key features. First, the present invention involves a binderless insulation. Prior art insulation batts generally include a binder. The presence of the binder holds the prior art fibers into a rigid pre-defined matrix. Fibers held by binder are incapable of movement beyond the pre-defined matrix. Thus, an insulation employing binderless mineral fibers will be capable of much greater movement than more rigid bindered fibers. As used in the present specification and claims, the term "binderless" means the absence of binder materials or the presence of only small amounts of such binder materials, amounting to no more than one percent (1%), by weight. Addition of suppressants, e.g. oils, for dust control or other purposes is not considered a binder.

The second key feature of the present invention involves the use of substantially long fibers. Traditional prior art processes employ short fibers due to entanglement problems which create an undesirable appearance and reduced insulating ability. The present invention, on the other hand, employs substantially long mineral fibers. The long fibers in the batt are collected in such a way that they do not overly entangle to the extent that they do in prior art processes. As a result, there are more individual fibers that can act independently in the insulation of the present invention.

As used herein the, phrase "the use of substantially long fibers" refers to the use of a substantial proportion of long fibers, that is generally 20% or more by weight or number. Furthermore, for purposes of this patent specification, the term "short" fibers is intended to include fibers of approximately 2.54 centimeters (cm) (1 inch) in length and less and the term "long" fibers is intended to include fibers longer than approximately 5.08 cm (2 inches), preferably 17.78 cm (7 inches) and more preferably 30.48 cm (12 inches).

The present invention involves a conformable insulation of mineral fibers. Preferably, the mineral fibers are glass fibers. The glass fibers employed may be either conventional straight fibers or, preferably, bicomponent, irregularly-shaped glass fibers. Irregularly-shaped glass fibers and methods for producing them are disclosed in co-pending and commonly assigned U.S. Pat. No. 5,431,992, entitled DUAL-GLASS FIBERS AND INSULATION PRODUCTS THEREFROM, by Houpt et al, the disclosure of which is herein incorporated by reference. The fiber batt of the present invention may be, for example, constructed of low density fibrous glass wool having a density of less than about 0.6 p.c.f. (9.61 kg/M$^3$). Preferably, the batt has a density of between 0.30 p.c.f. (4.81 kg/M$^3$) and 0.50 p.c.f. (8.01 kg/M$^3$).

Returning to FIG. 2, mineral fiber batt 20 includes a top portion 24, a bottom portion 25, a side surface 26 and a opposed side surface 27. The fiber batt of the present invention may exist on its own or may be included as part of an insulation assembly. As the fiber batt of the present invention lacks a binder some degree of product integrity is surrendered. However, due to the nature of the long fibers, the batt maintains sufficient desire to remain as an integral product that the batt does not readily disintegrate. Rather, the batt of the present invention remains an integral product with uniform weight distribution throughout.

Figure 4:
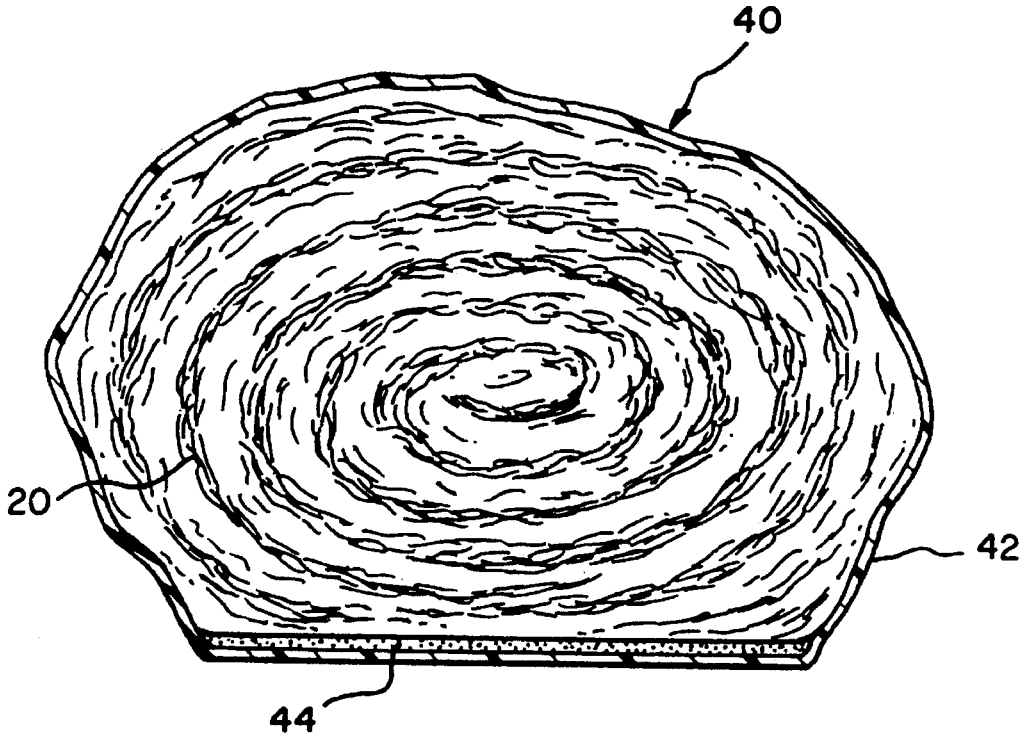
FIG. 4 is an end view of the preferred insulation assembly of the present invention.

When the mineral fiber batt 20 is incorporated into an insulation assembly, an exterior layer is added over the fiber batt. An insulation assembly 40 according to the present invention is shown in FIG. 4. FIG. 4 includes mineral fiber batt 20 surrounded by an exterior layer 42. The exterior layer may cover only one surface such as the top surface only or any number of surfaces including complete encapsulation of the fiber batt.

The exterior layer may be constructed from, for example, plastics such as polyethylene, polybutylene, A-B self reacting coatings or crosslinked polymers which are hardened on the batt surface by the use of electron beams, metallized films, Kraft paper or non-woven materials. In the preferred assembly, the exterior layer is a polyethylene film. The film preferably has a thickness of about 1.0 mil or less, more preferably, 0.2 mil to 0.6 mil, with the ideal thickness being 0.4 mil. In some cases, it is desirable to perforate the exterior layer. Such perforations enhance the ease of batt splitting, splitting of the fibrous batt to fit around obstacles such a pipe or conduit, during installation.

Insulation assembly 40 may also include a means for restricting movement between the fiber batt 20 and the exterior layer 42. The means for restricting movement retards relative movement between the mineral fiber batt and the exterior layer. This is particularly useful when the assembly 40 is placed in a vertical position such as between wall studs. Means for restricting movement may include adhesives, fasteners or the configuration of the exterior layer. Where the exterior layer is a polyethylene film, it may be applied directly to the fiber batt in a heated, tacky condition which will join the film to the fiber batt upon cooling.

The preferred means is an adhesive material 44 applied between the fiber batt 20 and the exterior layer 42. The adhesive material may be applied as a layer, strip or other pattern such as dots. The adhesive layer may be applied to one or more surfaces of the fiber batt 20 or may be an integral part of the film, with one side of the film providing the adhesive layer to join to the fiber batt.

In the preferred embodiment, one or more air passages (not shown) are provided in exterior layer 42. Air passages allow atmospheric air to reach the mineral fiber batt 20. Prior to shipping, the insulation assembly may be tightly compressed, forcing air from the interior of the batt. Upon installation, air passages allow air to return to the interior of the batt, returning the assembly to its pre-compressed state. An open end, for example, may provide the air passage. In other embodiments, holes or slits may be provided in the exterior layer to provide the air passages.

The method of formation and collection of the long, binderless fibers of the present invention is not critical, provided the long fibers are collected in such a manner that they do not overly entangle. In fact, most formation and collection techniques currently used for short fibers may be employed with modification. Examples include the processes as described in U.S. Pat. Nos. 4,120,676, 5,268,015 and 5,051,123.

These conventional processes are modified in a manner such that the long fibers are not overly entangled during collection. Most traditional collection methods collect fibers in a rather wide collection zone, for example, 52 inches (132 cm) or more so that a wide batt is formed. Such a wide zone is achieved by whipping or blowing the fibers as they leave the fiberizer. This causes the entanglement and roping problems. Such a wide zone is required because the batt later needs to be cut to proper size in the manufacturing process.

As the insulation of the present invention need not be cut, a much narrower collection zone, for example 24 inches (61 cm) or less can be employed. This reduces the roping and entanglement problems associated with the prior art. What is important is that the fibers produced are long, not overly entangled and binderless.

The preferred method for producing the conformable insulation of the present invention involves a direct forming process, as disclosed in co-pending and commonly assigned U.S. patent application Ser. No. 08/240,428 filed May 10, 1994 entitled DIRECT FORMING METHOD OF COLLECTING LONG WOOL FIBERS, by Scott et al, the disclosure of which is herein incorporated by reference.

The method begins with producing a veil of moving gases and long glass fibers with a rotary fiberizing apparatus. The veil travels in a generally downward direction, with the long fibers therein having a generally spiral trajectory imparted by the rotary fiberizing apparatus. The fibers are captured on at least two opposed first conveyor surfaces immediately below the fiberizing apparatus, generally within from two to six feet of the fiberizing apparatus. The fibers are not allowed to fall the substantial distances, commonly from eight to fifteen feet, that fibers in conventional methods fall. The captured fibers are interrelated or oriented in a generally spiral relationship.

Once captured, a wool pack or batt is formed while maintaining the fibers in a generally spiral relationship. Capturing the fibers on the first conveyor surfaces includes separating and exhausting the gases from the veil of fibers creating the wool batt. The conveyors are usually foraminous and the gases are withdrawn through the conveyors themselves. Following exit from the first conveyor surfaces, the batt is passed into and through a second set of opposed conveyor surfaces. This second set of conveyors serves to shape and form the batt during its transit. The generally spiral relationship is maintained throughout the formation of the wool batt.

Figure 3A:
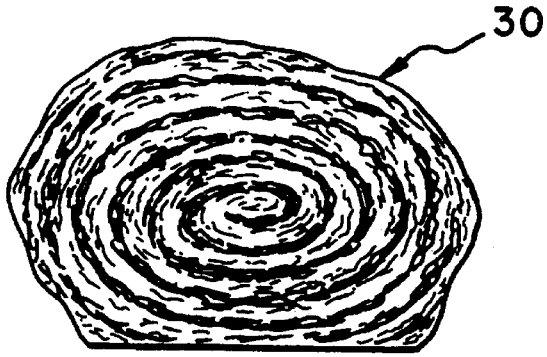
FIG. 3A–3D are end views of the preferred conformable insulation of the present invention.
Figure 3B:
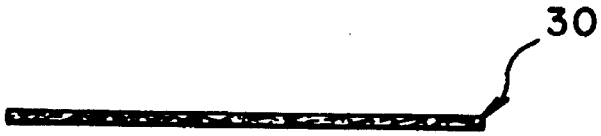

Most conventional methods employ a cutting stage in order to shape the batt into a rectangle. In the present invention, the wool batt remains uncut during the formation and shaping stages. Rather, shaping is performed by a second set of conveyors. As a result, the batt of the present invention does not resemble the perfect rectangle of the prior art. The conformable batt of the present invention can be seen in FIG. 3A. FIG. 3A shows an end view of conformable batt 30 of the present invention. As can be seen, batt 30 has a crude elliptical or oval shape, rather than a rectangular shape.

Following formation of the conformable batt of the present invention, the batt may be packaged for shipping and installation. If the conformable batt is to be part of assembly 40 as in FIG. 4, the exterior layer 42 and adhesive layer 44 are applied after formation of the batt. The application of the exterior layer and adhesive layer are in accordance with known techniques.

Following application of any additional layers to the wool batt, the entire assembly is passed through a pair of shaping rollers positioned adjacent to the sides of the assembly. The shaping rollers engage the sides of the assembly and form a crease or tuck in the side edges. This crease or tuck forces in the sides of the assembly providing for a more uniform side prior to compression. The crease or tuck is positioned in the center of the sides and extends longitudinally the length of the batt. Once the sides have been creased, the wool batt is packaged for shipping. Packaging may involve any conventional packaging techniques such as rolling, compression, or other means. One of the many features of the present invention is that after compression the recovery ratio is at least 12 to 1. That is, the final thickness of the expanded insulation assembly 40 is at least 12 times the thickness of the assembly 40 while in a compressed state.

When the preferred direct form method is employed, an additional feature of the present invention is the use of mineral fibers oriented in a generally spiral relationship within the batt when viewed from an end of the batt. Prior art insulation products employ fibers that are layered horizontally when viewed from an end. On the other hand, the conformable insulation of the present invention orients the fibers in a spiral relationship. FIG. 2 shows an end view of the conformable insulation of the present invention. As can be seen, when viewed from the end, the conformable insulation batt 20 employs spirally oriented fibers 22. The spiral orientation of the fibers provides, in combination with the other features, the fiber batt of the present invention the capability to expand and conform axially.

The fibers of the present invention are also oriented longitudinally along the length of the fiber batt. That is, while the fibers are in a generally spiral relationship when viewed from an end, the fibers are also spring or helical shaped along the longitudinal axis. Thus, the fiber batt of the present invention has a continuum of fibers around the perimeter. As the fibers encompassing both the top or bottom and the sides are, in many cases, the same set of fibers, there is interrelationship between the top or bottom and the sides. If a bundle of fibers were grasped at one end and pulled, the fiber batt would, in essence, unwind as one continuous rope.

Figure 3C:
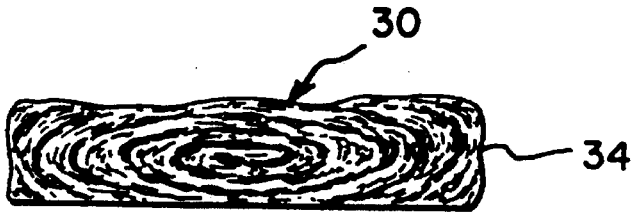

It is in installation of the batt of the present invention, that the advantages of conformable insulation are realized. FIGS. 3A–3D show end views of the conformable insulation of the present invention. Wool batt 30 is shown compressed for shipping in FIG. 3B. Once the insulation is removed from packaging, the batt shows a recovery from compression as shown in FIG. 3C. After handling associated with installation, the wool batt 30 shows an even greater recovery. The crease or tuck 34 placed prior to packaging can clearly be seen in both FIG 3C and FIG. 3D.

Figure 3D:
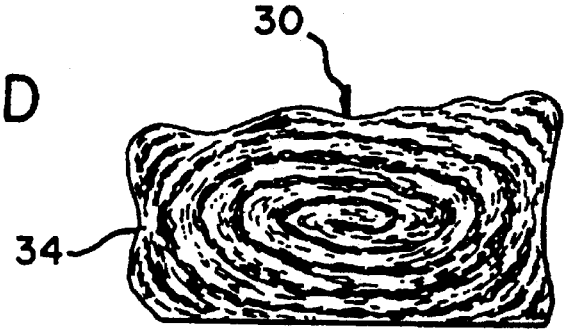

While conventional insulation at the point of FIG. 3D has assumed close to its final shape, the conformable insulation of the present invention continues to expand and, in so doing, does a better job of conforming its shape to the area available to it. It is in this manner, that the insulation of the present invention expands and conforms its shape to fill abnormal voids and spaces 16 as shown in FIG. 2. As the wool batt 30 continues to recover and expand, the crease or tuck 34 is no longer as prevalent.

Figure 5:
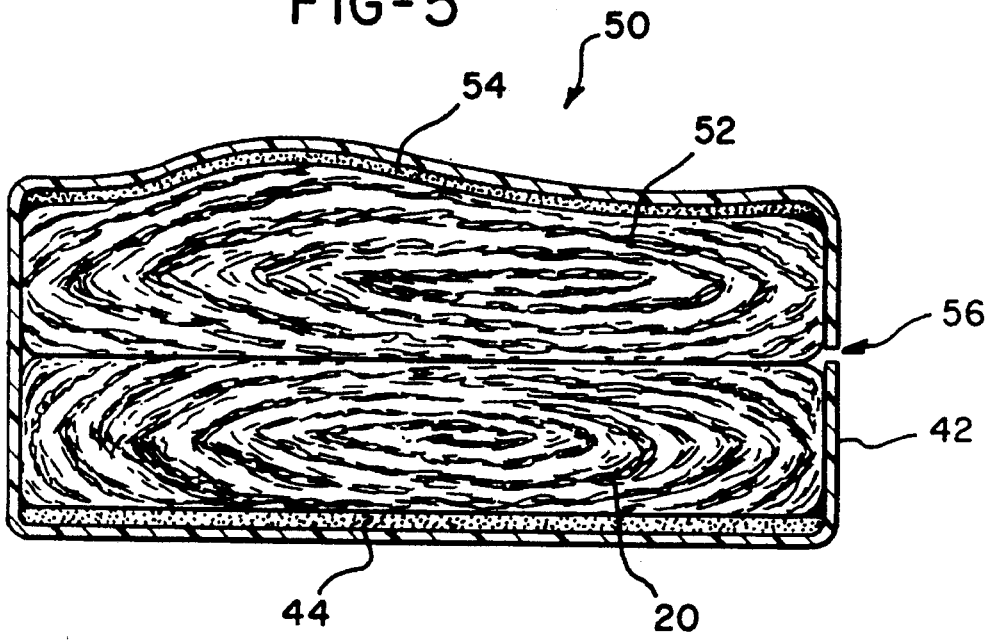
FIG. 5 is an end view of an additional embodiment of the present invention.

In an additional embodiment of the present invention, the conformable insulation of the present invention may comprise more than one fibrous batt in an assembly as shown in FIG. 5. FIG. 5 shows conformable insulation assembly 50 comprising first mineral fiber batt 20 and second mineral fiber batt 52 encapsulated by exterior layer 42. Exterior layer 42 is attached to first fibrous batt 20 by means of adhesive layer 44 and to second fibrous batt 52 by means of adhesive layer 54. Assembly 50 further may include side perforations 56 at the confluence of the two fibrous batts.

Assembly 50 may be formed from two or more parallel product lines. That is, two or more fiberizers output each one fibrous batt. The fibrous batts are conveyed along generally straight, laterally spaced apart, parallel paths. The parallel paths eventually converge into one path where the fibrous batts are combined into one assembly. The assembly is passed to an encapsulation stage where they are both encapsulated in a single exterior layer.

The combined assembly 50 may comprise two or more fibrous batts. The fibrous batts may be superposed on each other, may be placed adjacent each other, or a combination thereof. Preferably, assembly 50 comprises two fibrous batts superposed on each other and encapsulated in a polyethylene exterior layer as described earlier.

Figure 6:
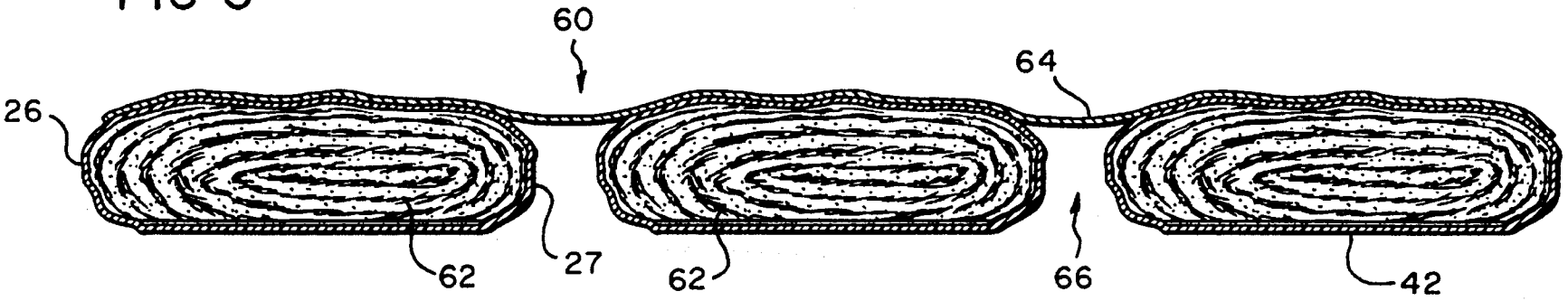
FIG. 6 is an end view of the multiple batt assembly of the present invention.

In another embodiment of the present invention, a multiple conformable insulation assembly is provided. Turning to FIG. 6, there is seen a multiple conformable batt assembly 60. The assembly 60 comprises at least two mineral fiber batts 62 which are interconnected to one another. Although the batts are interconnected, they are separated from each other by a defined distance 66. Interconnection of the fiber batts reduces the amount of time required for installation as a number of batts may be installed simultaneously.

Defined distance 66 allows the interconnected batts to be installed into multiple cavities at the same time with a minimal amount of effort. Preferably, defined distance 66 is approximately equivalent to the width of standard construction members, such as joists and studs. However, defined distance 66 may also be the width of other items such as, wires, piping or HVAC ductwork.

Fiber batts 62 may be interconnected by various means such as tabs, strands such as wire or string, straps or various other connection means. Preferably, fiber batts 62 are interconnected by means of a support layer 64. Support layer 64 may consist of plastic, metallized films, Kraft paper, non-woven materials or combinations thereof. Preferably, the support layer is a plastic, such as polyethylene. The support layer may have the dual function of interconnecting the multiple fiber batts as well as acting as a vapor barrier layer.

Figure 7:
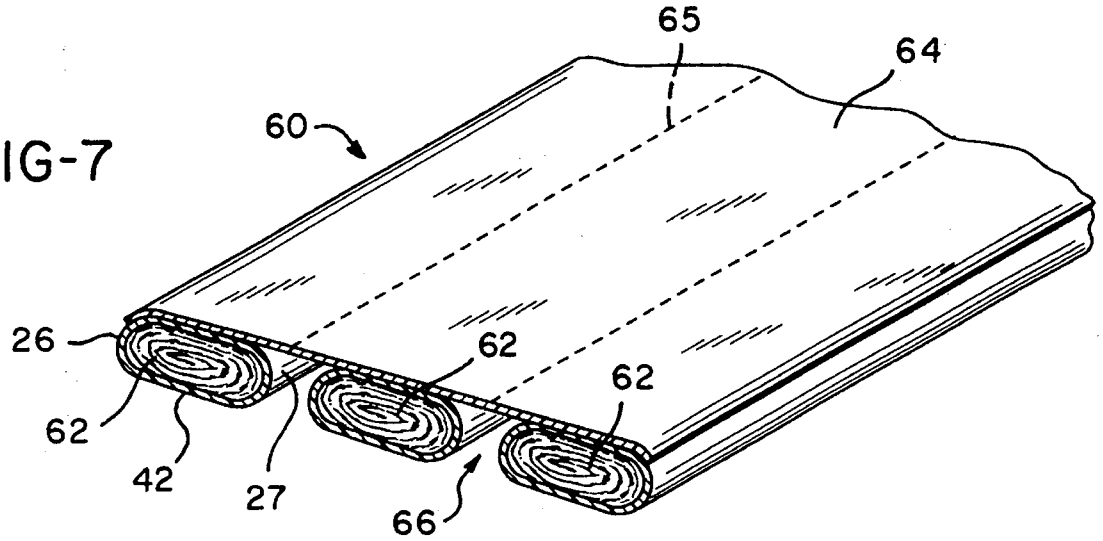
FIG. 7 is a perspective view of the multiple batt assembly of FIG. 6.

The support layer 64 may further include perforations 65 as shown in FIG. 7 to allow easy separation of fiber batts 62, preventing waste and reducing installation time. Of course, when perforations are included the effectiveness of support layer 64 as a vapor barrier is reduced. The mineral fiber batts 62 may be attached to support layer 64 by various means, including staples, pins, stitching and other common means. Preferably, an adhesive is used to attached fiber batts 62 to support layer 64.

Mineral fiber batts 62 are conformable insulation batts as disclosed in earlier embodiments. That is, the batts are adapted to conform and expand their shape to an area into which they are installed. The batts 62 are comprised of a binderless fibrous material of substantially long fibers. The fibers are the same as those for earlier embodiments of the present invention, preferably, irregularly-shaped glass fibers. Again as in earlier embodiments, the fibers may be oriented within each of the fiber batts 62 in a generally spiral relationship when viewed from the end of each batt. The sides, 26 and 27, again remain uncut and the batt 62 may be encapsulated in an exterior layer 42. More than one fiber batt 62 may be included within one exterior layer as in FIG. 5.

The conformable insulation of the present invention needs less cutting to be shaped to fit around obstacles in the installation area when compared to prior art insulation products. The insulation performs better in expanding and conforming its shape to the available area around the obstacle filling in the remaining spaces and voids near the obstacle when compared to the prior art. This feature alone is a substantial improvement over prior art installation products.

Accordingly, the conformable insulation of the present invention is ideally suited for installation in building construction such as in walls, floors or attics. The conformable insulation has the unique ability to expand and conform its shape to the area into which it is installed. This ability increases both the visual and performance characteristics of the insulation. The insulation does not require cutting along its length during manufacturing. The prior art does require such cutting.

Having described the invention in detail and by reference to the preferred embodiments thereof, it will be apparent that modifications and variations are possible without departing from the scope of the invention which is defined in the appended claims.

I claim:

1. A conformable insulation assembly comprising:

at least two interconnected mineral fiber batts spaced apart by a defined distance, said mineral fiber batts being comprised of a binderless fibrous material of substantially long fibers, each of said batts adapted to expand and conform its shape to an area into which said mineral fiber batt is installed, wherein said long fibers are oriented within each of said mineral fiber batts in a generally spiral relationship when viewed from an end of said batt.

2. The insulation assembly as claimed in claim 1 wherein said mineral fiber batts are interconnected with a support layer.

3. The insulation assembly as claimed in claim 2 wherein said support layer is selected from the group consisting of plastic, metallized films, Kraft paper, non-woven materials and combinations thereof.

4. The insulation assembly as claimed in claim 3 wherein said support layer is a plastic film.

5. The insulation assembly as claimed in claim 2 further including perforations in said support layer to allow separation of said mineral fiber batts.

6. The insulation assembly as claimed in claim 2 further comprising an adhesive for attaching said mineral fiber batts to said support layer.

7. The insulation assembly as claimed in claim 1 wherein said defined distance approximates the width of standard construction members.

8. The insulation assembly as claimed in claim 1 wherein said mineral fibers are irregularly-shaped glass fibers.

9. The insulation assembly as claimed in claim 1 wherein each of said mineral fiber batts has a top, bottom and two opposing, spaced apart sides, said opposing sides remaining uncut during manufacture of said assembly.

10. The insulation assembly as claimed in claim 9 further comprising an exterior layer on at least one of the top, bottom or opposing side surfaces of said batt, said exterior layer being selected from the group consisting of plastic, metallized films, Kraft paper, non-woven materials and combinations thereof.

11. The insulation assembly as claimed in claim 10 wherein said exterior layer is plastic.

12. The insulation assembly as claimed in claim 10 wherein two fibrous batts are encapsulated within one exterior layer.

13. A conformable insulation assembly comprising at least two fibrous glass batts interconnected to one another by a support layer and spaced apart by a defined distance, said fibrous glass batts being comprised of binderless, substantially long glass fibers, each of said fibrous glass batts being encapsulated by an exterior plastic layer, each of said batts being adapted to expand and conform its shape into an area into which said batt has been installed, wherein said long glass fibers are oriented within each of said batts in a generally spiral relationship when viewed from an end of said batts.

14. The insulation assembly as claimed in claim 13 wherein said support layer is selected from the group consisting of plastic, metallized films, Kraft paper, non-woven materials and combinations thereof.

15. The insulation assembly as claimed in claim 14 wherein said support layer is plastic.

16. The insulation assembly as claimed in claim 13 further including perforations in said support layer.

17. The insulation assembly as claimed in claim 13 wherein said glass fibers are irregularly-shaped glass fibers.

18. The insulation assembly as claimed in claim 13 wherein said defined distance approximates the width of standard construction members.

19. The insulation assembly as claimed in claim 13 wherein two fibrous glass batts are encapsulated within each exterior layer.

* * * * *